US008284965B2

(12) United States Patent
Liu et al.

(10) Patent No.: US 8,284,965 B2
(45) Date of Patent: Oct. 9, 2012

(54) THERMOACOUSTIC DEVICE WITH FLEXIBLE FASTENER AND LOUDSPEAKER USING THE SAME

(75) Inventors: Liang Liu, Beijing (CN); Chen Feng, Beijing (CN); Li Qian, Beijing (CN); Yu-Quan Wang, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 313 days.

(21) Appl. No.: 12/848,221

(22) Filed: Aug. 2, 2010

(65) Prior Publication Data

US 2011/0158446 A1 Jun. 30, 2011

(51) Int. Cl.

| | |
|---|---|
| ***H04R 1/06*** | (2006.01) |
| ***H01R 4/48*** | (2006.01) |
| ***H01R 11/22*** | (2006.01) |
| *H04R 1/00* | (2006.01) |
| *H01R 4/28* | (2006.01) |
| *H01R 11/11* | (2006.01) |

(52) U.S. Cl. ..... 381/164; 381/392; 381/394; 381/395; 439/857; 439/816

(58) Field of Classification Search ..... 381/163, 381/164, 392, 394, 395, 398, 190; 181/171, 181/172; 439/65, 857, 856, 816
See application file for complete search history.

(56) References Cited

U.S. PATENT DOCUMENTS

| | | | | |
|---|---|---|---|---|
| 6,570,299 | B2 * | 5/2003 | Takeshima et al. | 310/348 |
| 6,621,616 | B1 * | 9/2003 | Bauer et al. | 359/273 |
| 6,653,762 | B2 * | 11/2003 | Takeshima | 310/340 |
| 6,912,288 | B2 * | 6/2005 | Nakashima et al. | 381/190 |
| 6,965,680 | B2 * | 11/2005 | Yamauchi et al. | 381/190 |
| 7,045,108 | B2 | 5/2006 | Jiang et al. | |
| 7,384,269 | B2 * | 6/2008 | Jang et al. | 439/65 |
| 8,238,586 | B2 * | 8/2012 | Qian et al. | 381/164 |
| 2005/0122048 | A1 * | 6/2005 | Kang et al. | 313/635 |
| 2006/0018128 | A1 * | 1/2006 | Park et al. | 362/600 |
| 2006/0170321 | A1 * | 8/2006 | Lee et al. | 313/234 |
| 2007/0166223 | A1 | 7/2007 | Jiang et al. | |
| 2008/0248235 | A1 | 10/2008 | Feng et al. | |
| 2008/0299031 | A1 | 12/2008 | Liu et al. | |
| 2010/0172213 | A1 * | 7/2010 | Qian et al. | 367/140 |

FOREIGN PATENT DOCUMENTS

WO W02007015710 2/2007

* cited by examiner

*Primary Examiner* — Edgardo San Martin
(74) *Attorney, Agent, or Firm* — Altis Law Group, Inc.

(57) ABSTRACT

A thermoacoustic device includes a base, a plurality of first fasteners, at least one first electrode, at least one second electrode and a sound wave generator. Each of the first fasteners includes a body engaging with the base and a flexible element extending from the body. The at least one first electrode has a first end and a second end. The first end engages with the flexible element of the plurality of first fasteners, and the second end is secured on the base. The at least one second electrode has a third end and a fourth end. The third end engages with the flexible element of the plurality of first fasteners, and the fourth end is secured on the base. The sound wave generator is electrically connected to the at least one first electrode and the at least one second electrode.

20 Claims, 10 Drawing Sheets

THERMOACOUSTIC DEVICE WITH FLEXIBLE FASTENER AND LOUDSPEAKER USING THE SAME

CROSS-REFERENCE TO RELATED APPLICATIONS

This application claims all benefits accruing under 35 U.S.C. §119 from China Patent Application No. 200910260283.2, filed on Dec. 28, 2009, in the China Intellectual Property Office, the disclosure of which is incorporated herein by reference.

BACKGROUND

1. Technical Field

The present disclosure relates to thermoacoustic devices, loudspeakers and, particularly, to a thermoacoustic device having flexible fasteners and a loudspeaker using the same.

2. Description of Related Art

Thermoacoustic effect is a conversion of heat to acoustic signals. The thermoacoustic effect is distinct from the mechanism of the conventional speaker, which the pressure waves are created by the mechanical movement of a diaphragm. When signals are input into a thermoacoustic element, heat is produced in the thermoacoustic element according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp22-38 (1917)). They used platinum strip with a thickness of $7\times10^{-5}$ cm as a thermoacoustic element. The heat capacity per unit area of the platinum strip with the thickness of $7\times10^{-5}$ cm is $2\times10^{-4}$ J/cm$^2$*K. However, the thermophone adopting the platinum strip, heard in the open air, sounds extremely weak because the heat capacity per unit area of the platinum strip is too high.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Fan et al. discloses a thermoacoustic device with simpler structure and smaller size, working without the magnet in an article of "Flexible, Stretchable, Transparent Carbon Nanotube Thin Film Loudspeakers", Fan et al., Nano Letters, Vol.8 (12), 4539-4545 (2008). The thermoacoustic device includes a sound wave generator which is a carbon nanotube film. The carbon nanotube film used in the thermoacoustic device has a large specific surface area, and extremely small heat capacity per unit area that make the sound wave generator emit sound audible to humans. The sound has a wide frequency response range. Accordingly, the thermoacoustic device adopted the carbon nanotube film has a potential to be used in place of the loudspeakers of the prior art.

However, the carbon nanotube film is electrically supported by two electrodes, and the carbon nanotube film will generate heat during operation and the electrodes will be heated and deformed in a direction perpendicular to an axis direction of the electrodes due to expansion caused by the heating. The deformation of the electrodes in the direction perpendicular to the axis direction can possibly cause deformation or breakage of the carbon nanotube film.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
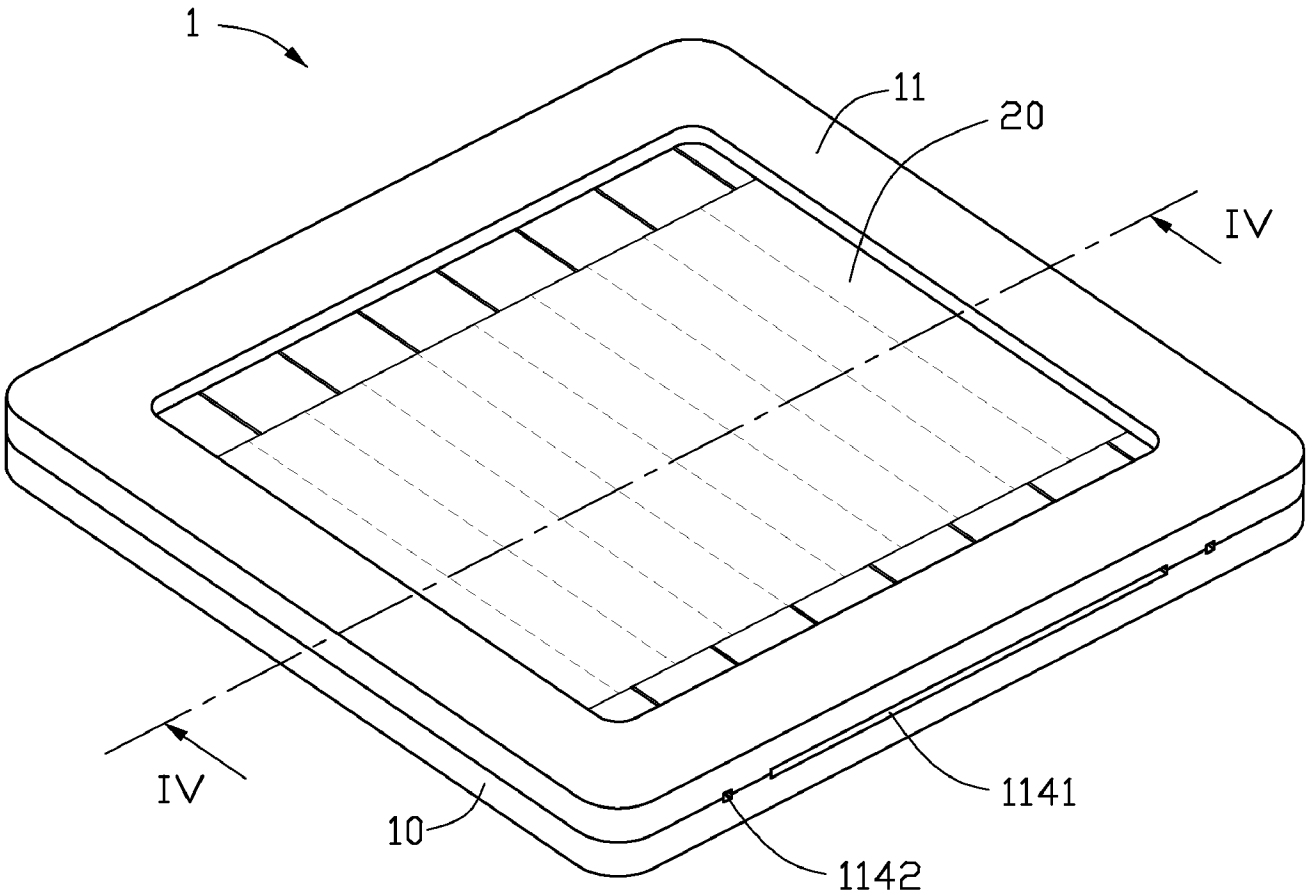
FIG. 1 is a schematic structural view of an embodiment of a loudspeaker having a thermos acoustic device.

Referring to FIG. 1, one embodiment of a loudspeaker 1 is provided. The loudspeaker 1 comprises a framework 10 and a thermoacoustic device 20.

Figure 2:
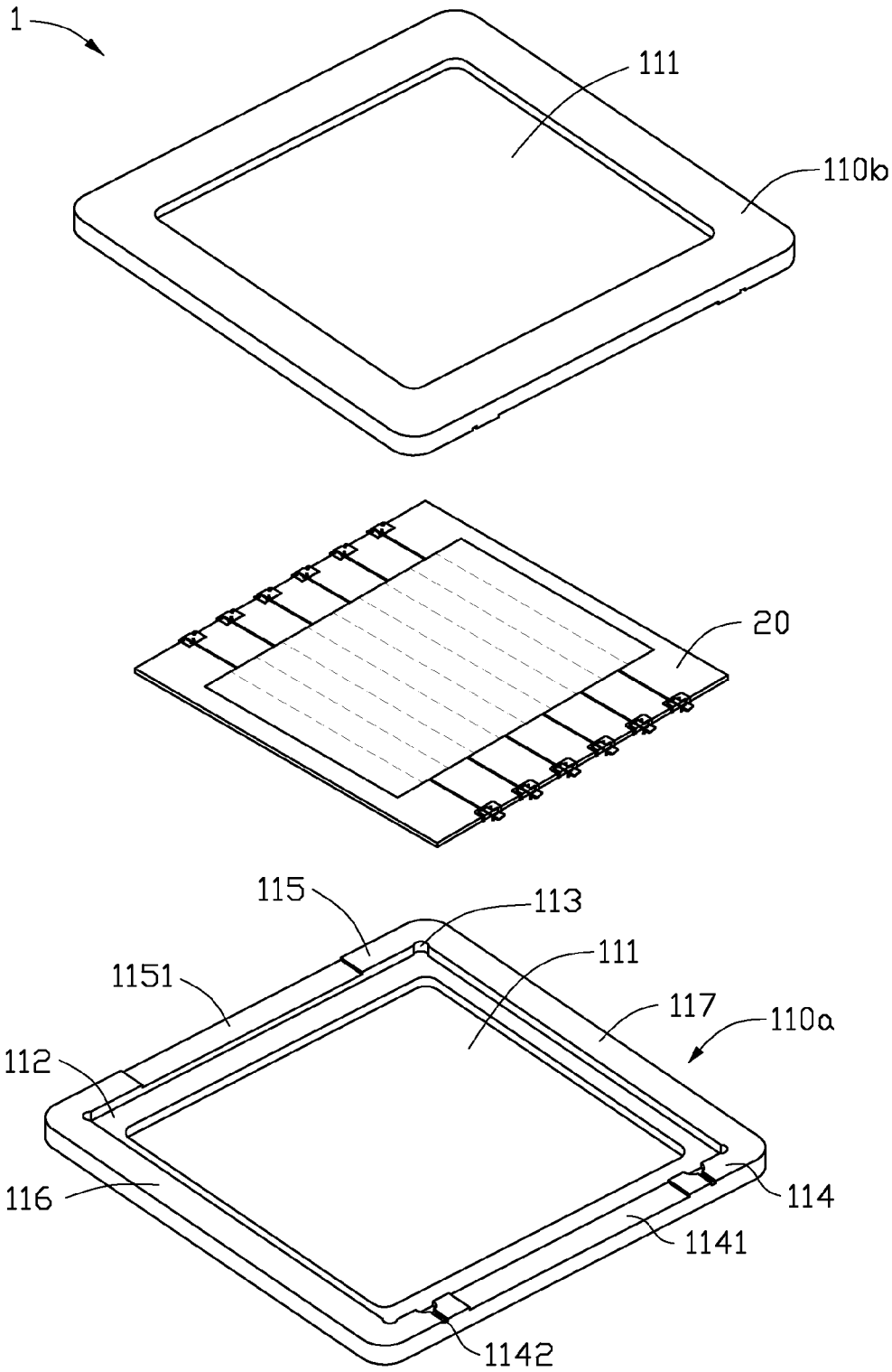
FIG. 2 is an exploded schematic structural view of FIG. 1.

In one embodiment shown in FIG. 2, the framework 10 comprises a first frame 110*a* and a second frame 110*b*. The first frame 110*a* and the second frame 110*b* can be secured to each other, so that the thermoacoustic device 20 can be installed therebetween. In some examples, the first frame 110*a* and the second frame 110*b* can be secured together with rivets, screws, or adhesive.

The first frame 110*a* and the second frame 110*b* can have the same structure and are symmetrically arranged about the thermoacoustic device 20. The first frame 110*a* will be taken as an example to illustrate the structure of the first frame 110*a* and the second frame 110*b*. The first frame 110*a* is a substantially rectangular frame formed by four members 114, 115, 116 and 117 joined end to end. The four members 114, 115, 116, and 117 define an approximately square opening 111. A flange 112 inwardly extends from an inner edge of each of the members 114, 115, 116, and 117, and a step is formed between the flanges 112 and corresponding one of the members 114, 115, 116, and 117. The flanges 112 contact the thermoacoustic device 20. A notch 113 is defined in a joint portion between the adjacent two members 114, 115, 116, and 117. The notches 113 communicate with the opening 111. The presence of the notches 113 can avoid interference between corners of the thermoacoustic device 20 and the framework 10.

Two substantially T-shaped grooves 1142 are formed and spaced apart at opposite substantial corners in a top surface of the member 114. The grooves 1142 are provided for the convenience of receiving the external signals. A first heat radiating groove 1141 is formed in the top surface of the member 114 between the two grooves 1142. A second heat radiating groove 1151 is formed in a top surface of the member 115 which is opposite to the member 114. The first radiating groove 1141 and the second heat radiating groove 1151 can be arranged in a line so as to increase heat exchange between ambient medium and the thermoacoustic device 20.

Figure 3:
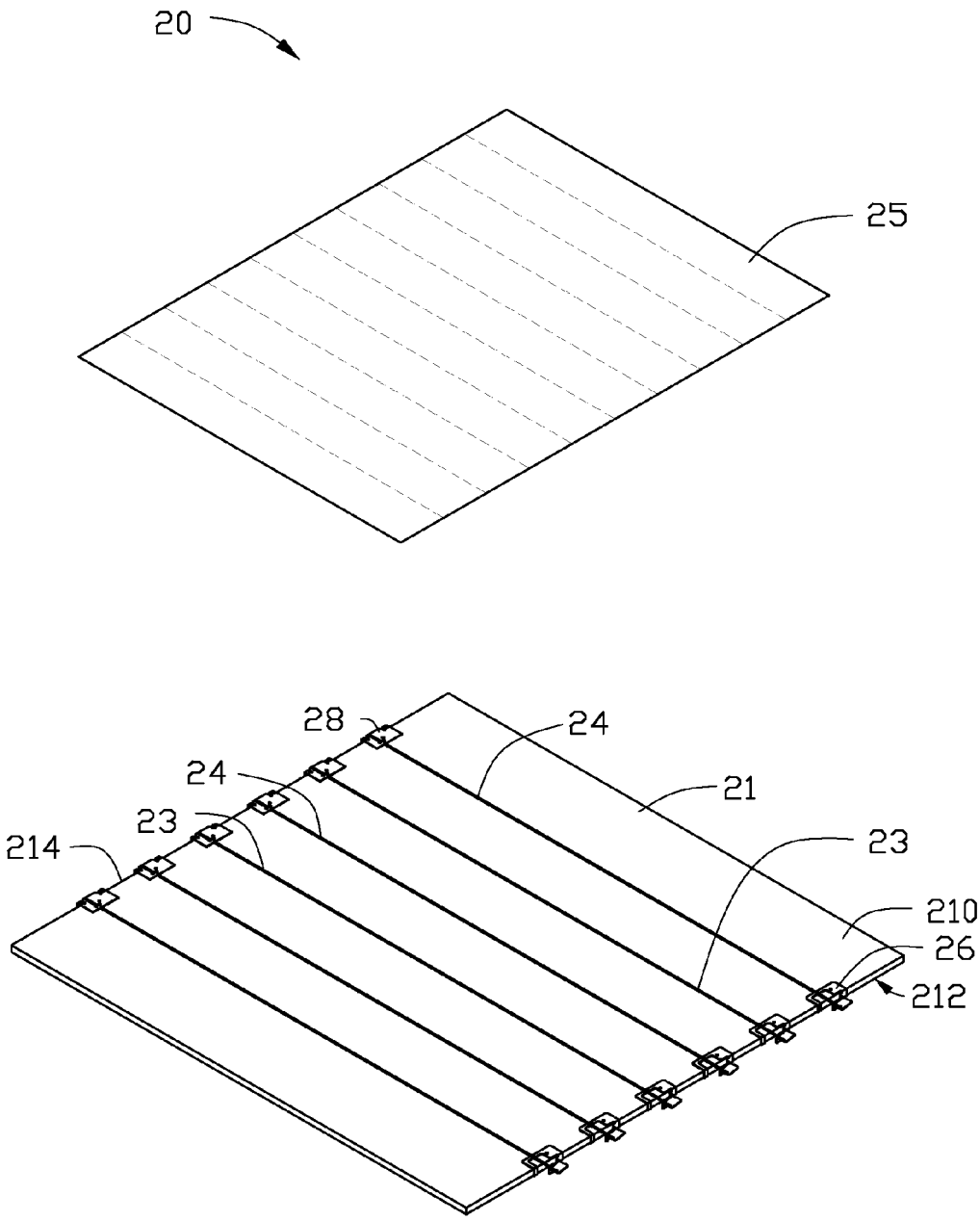
FIG. 3 is an exploded schematic structural view of a thermoacoustic device of FIG. 2.

Referring to FIG. 3, the thermoacoustic device 20 comprises a base 21, a plurality of first electrodes 23, a plurality of second electrodes 24, a sound wave generator 25, a plurality of first fasteners 26 and a plurality of second fasteners 28. The first electrodes 23 and the second electrodes 24 are secured on the base 21 via the first fasteners 26 and the second fasteners 28. The sound wave generator 25 is electrically supported by the first electrodes 23 and the second electrodes 24.

The base 21 can be a substantially rectangular transparent glass substrate. The base 21 has a surface 210, a first end 212 and an opposite second end 214. In other embodiments, the base 21 can be opaque. The shape and size of the base 21 is not limited. The base 21, as well as the framework 10 can be fabricated into square shape, round shape, ellipse shape or other shapes to adapt to actual needs of a desired loudspeaker design.

The first electrodes 23 and the second electrodes 24 are disposed on the surface 210 of the base 21. The first electrodes 23 and the second electrodes 24 are made of conductive material. The shapes of the first electrodes 23 and the second electrodes 24 are not limited and can be lamellar, rod, wire, or block among other shapes. Materials of the first electrodes 23 and the second electrodes 24 can be metals, alloys, conductive adhesives, carbon nanotubes, indium tin oxides, and other conductive materials. The metals can be tungsten, molybdenum and stainless steel. The first electrodes 23 and the second electrodes 24 can contact or spaced from the surface 210.

In one embodiment, the first electrodes 23 and the second electrodes 24 are rod-shaped stainless steel electrodes. The plurality of first electrodes 23 is electrically connected, and the plurality of second electrodes 524 is electrically connected. The first electrodes 23 and the second electrodes 24 are alternately arranged on the surface 210 of the base 21 as shown in FIG. 3. The first and second electrodes 23, 24 can provide structural support for the sound wave generator 25.

The sound wave generator 25 is electrically connected to the first electrode 23 and the second electrode 24. If the first electrodes 23 and the second electrodes 24 are alternately arranged on the surface 210 of the base 21 as shown in FIG. 3, a number of parallel connections of the portions of the sound wave generator 25 between the first electrodes 23 and the second electrodes 24 will be formed. The parallel connections in the sound wave generator 25 provide for lower resistance, thus input voltage required to the thermoacoustic device 20, to obtain the same sound level, can be lowered.

The sound wave generator 25 has a low heat capacity per unit area that can realize "electrical-thermal-sound" conversion. The sound wave generator 25 can have a large specific surface area for causing the pressure oscillation in the surrounding medium by the temperature waves generated by the sound wave generator 25. The heat capacity per unit area of the sound wave generator 25 can be less than $2\times10^{-4}$ J/cm$^2$*K.

In one embodiment, the sound wave generator 25 includes or can be a carbon nanotube structure. The carbon nanotube structure can have a large specific surface area (e.g., above 30 m$^2$/g). The heat capacity per unit area of the carbon nanotube structure is less than $2\times10^{-4}$ J/cm$^2$*K. In one embodiment, the heat capacity per unit area of the carbon nanotube structure is less than or equal to $1.7\times10^{-6}$ J/cm$^2$*K.

The carbon nanotube structure can include a plurality of carbon nanotubes uniformly distributed therein, and the carbon nanotubes therein can be combined by Van der Waals attractive force therebetween. It is understood that the carbon nanotube structure must include metallic carbon nanotubes. The carbon nanotubes in the carbon nanotube structure can be arranged orderly or disorderly.

The term 'disordered carbon nanotube structure' includes, but is not limited to, a structure where the carbon nanotubes are arranged along many different directions, arranged such that the number of carbon nanotubes arranged along each different direction can be almost the same (e.g. uniformly disordered); and/or entangled with each other.

'Ordered carbon nanotube structure' includes, but is not limited to, a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions).

The carbon nanotubes in the carbon nanotube structure can be selected from single-walled, double-walled, and/or multi-walled carbon nanotubes. Diameters of the single-walled carbon nanotubes range from about 0.5 nanometers to about 50 nanometers. Diameters of the double-walled carbon nanotubes range from about 1 nanometer to about 50 nanometers. Diameters of the multi-walled carbon nanotubes range from about 1.5 nanometers to about 50 nanometers. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The smaller the specific surface area of the carbon nanotube structure, the greater the heat capacity per unit area will be. The greater the heat capacity per unit area, the smaller the sound pressure level.

Figure 4:
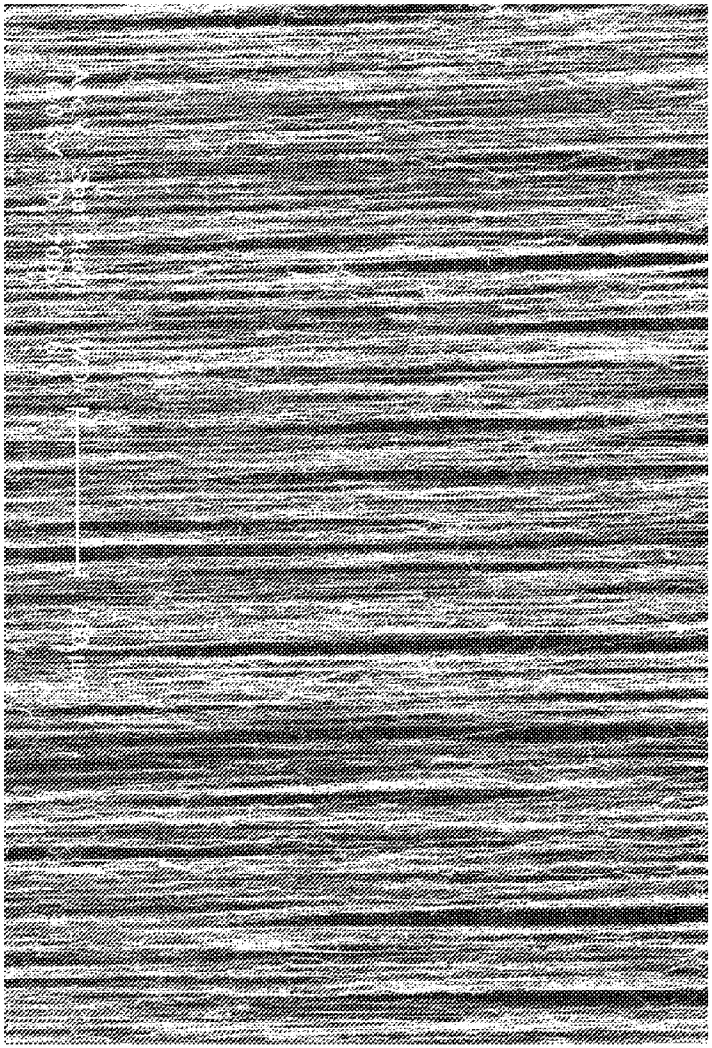
FIG. 4 shows a Scanning Electron Microscope (SEM) image of a drawn carbon nanotube film.
Figure 5:
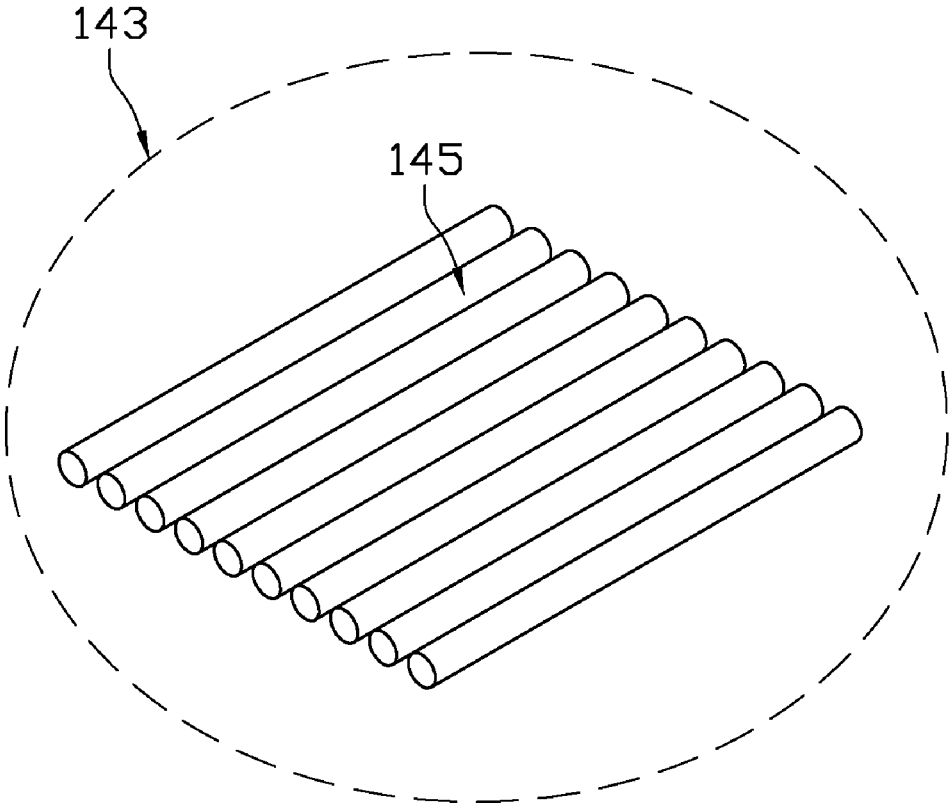
FIG. 5 is a schematic of a carbon nanotube segment.

In one embodiment, the carbon nanotube structure can include at least one drawn carbon nanotube film. Examples of a drawn carbon nanotube film are taught by U.S. Pat. No. 7,045,108 to Jiang et al., and WO 2007015710 to Zhang et al. The drawn carbon nanotube film includes a plurality of successive and oriented carbon nanotubes joined end-to-end by Van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 4 and 5, each drawn carbon nanotube film includes a plurality of successively oriented carbon nanotube segments 143 joined end-to-end by Van der Waals attractive force therebetween. Each carbon nanotube segment 143 includes a plurality of carbon nanotubes 145 parallel to each other, and combined by Van der Waals attractive force therebetween. As can be seen in FIG. 4, some variations can occur in the drawn carbon nanotube film. The carbon nanotubes 145 in the drawn carbon nanotube film are also oriented along a preferred orientation.

The drawn carbon nanotube film also can be treated with an organic solvent. After treatment, the mechanical strength and toughness of the treated drawn carbon nanotube film are increased and the coefficient of friction of the treated drawn carbon nanotube films is reduced. The treated drawn carbon nanotube film has a larger heat capacity per unit area and thus produces less of a thermoacoustic effect than the same film before treatment. A thickness of the drawn carbon nanotube film can range from about 0.5 nanometers to about 100 micrometers.

The carbon nanotube structure of the sound wave generator 25 also can include at least two stacked drawn carbon nanotube films. In other embodiments, the carbon nanotube structure can include two or more coplanar drawn carbon nanotube films. Coplanar drawn carbon nanotube films can also be stacked one upon other coplanar films. Additionally, an angle can exist between the orientation of carbon nanotubes in adjacent drawn films, stacked and/or coplanar. Adjacent drawn carbon nanotube films can be combined by only the Van der Waals attractive force therebetween without the need of an additional adhesive. The number of the layers of the drawn carbon nanotube films is not limited. However, as the stacked number of the drawn carbon nanotube films increases, the specific surface area of the carbon nanotube structure will decrease. A large enough specific surface area (e.g., above 30 $m^2/g$) must be maintained to achieve an acceptable acoustic volume. An angle between the aligned directions of the carbon nanotubes in the two adjacent drawn carbon nanotube films can range from 0 degrees to about 90 degrees. When the angle between the aligned directions of the carbon nanotubes in adjacent drawn carbon nanotube films is larger than 0 degrees, a microporous structure is defined by the carbon nanotubes in the sound wave generator 25. The carbon nanotube structure in one embodiment employing these films will have a plurality of micropores. Stacking the drawn carbon nanotube films will add to the structural integrity of the carbon nanotube structure.

In some embodiments, the carbon nanotube structure has a free standing structure and does not require the use of structural support. The term "free-standing" includes, but is not limited to, a structure that does not have to be supported by a substrate and can sustain the weight of itself when it is hoisted by a portion thereof without any significant damage to its structural integrity. A suspended part of the structure will have more sufficient contact with the surrounding medium (e.g., air) to have heat exchange with the surrounding medium from both sides thereof Furthermore, the drawn carbon nanotube film and/or the entire carbon nanotube structure can be treated, such as by laser, to improve the light transmittance of the drawn carbon nanotube film or the carbon nanotube structure. For example, the light transmittance of the untreated drawn carbon nanotube film ranges from about 70%-80%, and after laser treatment, the light transmittance of the untreated drawn carbon nanotube film can be improved to about 95%.

The carbon nanotube structure can be flexible and produce sound while being flexed without any significant variation to the sound produced. The carbon nanotube structure can be tailored or folded into many shapes and put onto a variety of rigid or flexible insulating surfaces, such as on a flag or on clothes and still produce the same quality sound.

The sound wave generator 25 having a carbon nanotube structure comprising of one ore more aligned drawn films has another striking property. It is stretchable perpendicular to the alignment of the carbon nanotubes. The carbon nanotube structure can be stretched to 300% of its original size, and can become more transparent than before stretching. In one embodiment, the carbon nanotube structure adopting one layer drawn carbon nanotube film is stretched to 200% of its original size. The light transmittance of the carbon nanotube structure, about 80% before stretching, is increased to about 90% after stretching. The sound intensity is almost unvaried during or as a result of the stretching.

The sound wave generator 25 is also able to produce sound waves faithfully or properly even when a part of the carbon nanotube structure is punctured and/or torn. If part of the carbon nanotube structure is punctured and/or torn, the carbon nanotube structure is able to produce sound waves faithfully. While, punctures or tears to a vibrating film or a cone of a conventional loudspeaker will greatly affect the performance thereof In the embodiment shown in FIGS. 2 and 3, the sound wave generator 25 includes a carbon nanotube structure comprising the drawn carbon nanotube film, and the drawn carbon nanotube film includes a plurality of carbon nanotubes arranged along a preferred direction. The thickness of the sound wave generator 25 is about 50 nanometers. It is understood that when the thickness of the sound wave generator 25 is small, for example, less than about 10 micrometers, the sound wave generator 25 has greater transparency. Thus, it is possible to acquire a transparent thermoacoustic device 20 by employing a transparent sound wave generator 25 comprising of a transparent carbon nanotube film in the thermoacoustic device 20.

Figure 6:
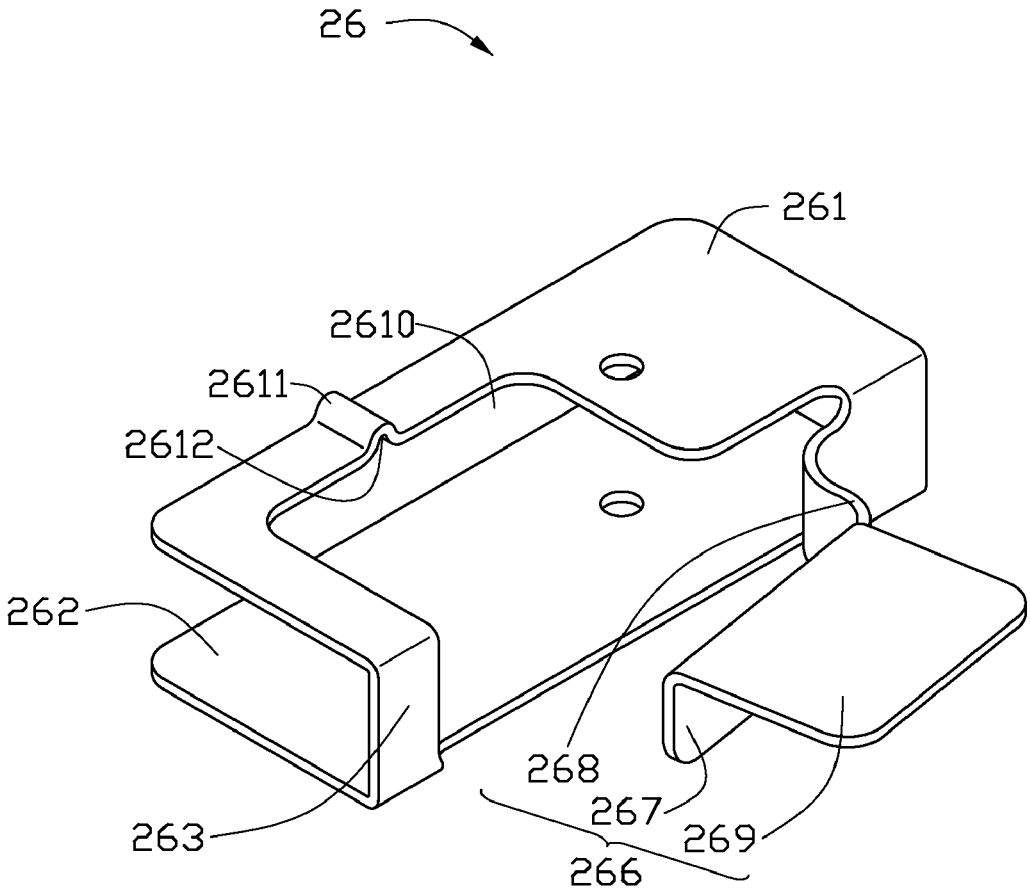
FIG. 6 is a schematic, enlarged view of a first fastener of FIG. 3.

Referring to FIG. 6, each of the first fasteners 26 has generally a U shape. The first fasteners 26 can be made of metals such as steel and copper. In order to increase the elasticity of metals, the metals can be heat treated. The first fasteners 26 can also be made of resin or plastic with good elasticity. The first fastener 26 comprises a first holding piece 261, a second holding piece 262, a first connecting piece 263, and a flexible element 266. The first holding piece 261 and the second holding piece 262 can be substantially parallel to each other. The first connecting piece 263 extends between the first holding piece 261 and the second holding piece 262. The first connecting piece 263 can be substantially perpendicular to the first holding piece 261 and the second holding piece 262.

The distance between the first holding piece 261 and the second holding piece 262 can be equal to or slightly smaller than the thickness of the base 21. Accordingly, the first holding piece 261 and the second holding piece 262 can tightly clamp opposite sides of the base 21 if the base 21 is inserted between the first holding piece 261 and the second holding piece 262. As a result, the first fastener 26 can be installed on the base 21 via engagement of the base 21 and the first and second holding pieces 261 and 262. The first and second holding pieces 261 and 262 and the first connecting piece 263 can also be referred as a body.

The flexible element 266 extends from the first connecting piece 263. In one embodiment shown in FIG. 6, the flexible element 266 extends from a middle area of the first connecting piece 263. The flexible element 266 is located at one side of the first connecting piece 263, and the first and second holding pieces 261 and 262 are located at an opposite side of the first connecting piece 263.

In details, the flexible element 266 comprises a neck portion 268 and an installing portion 267. The neck portion 268 diagonally or perpendicularly extends from the first connecting piece 263 in a direction away from the first holding piece 261 and the second holding piece 262. The installing portion 267 extends from a neck portion distal end 268. The installing portion 267 and the neck portion 268 together form a cantilever beam which has good elasticity in a direction substantially perpendicular to the first connecting piece 263.

The flexible element 266 can further include a first extending portion 269 formed on the installing portion 267. The first extending portion 269 substantially perpendicularly extends from the installing portion 267. The first extending portion 269 can be substantially parallel to the first holding piece 261.

The first extending portion 269 and the first holding piece 261 can also exist in a common plane. The first extending portion 269 and the installing portion 267 together form an L shape, and this facilitates installing or fixing at least one of the first electrodes 23 or the second electrode 24 on the first fasteners 26.

Furthermore, one first rib 2611 protrudes from the first holding piece 261 in a direction away from the second holding piece 262. Accordingly, a first wiring channel 2612 is formed under the first rib 2611 and opposite to the second holding piece 262. The first wiring channel 2612 can be substantially straight and extend in a direction substantially perpendicular to the installing portion 267. One first cutout 2610 is defined in the first holding piece 261 and the first connecting piece 263 between the first wiring channel 2612 and the installing portion 267, so that the first wiring channel 2612 can aim directly at the installing portion 267.

Figure 7:
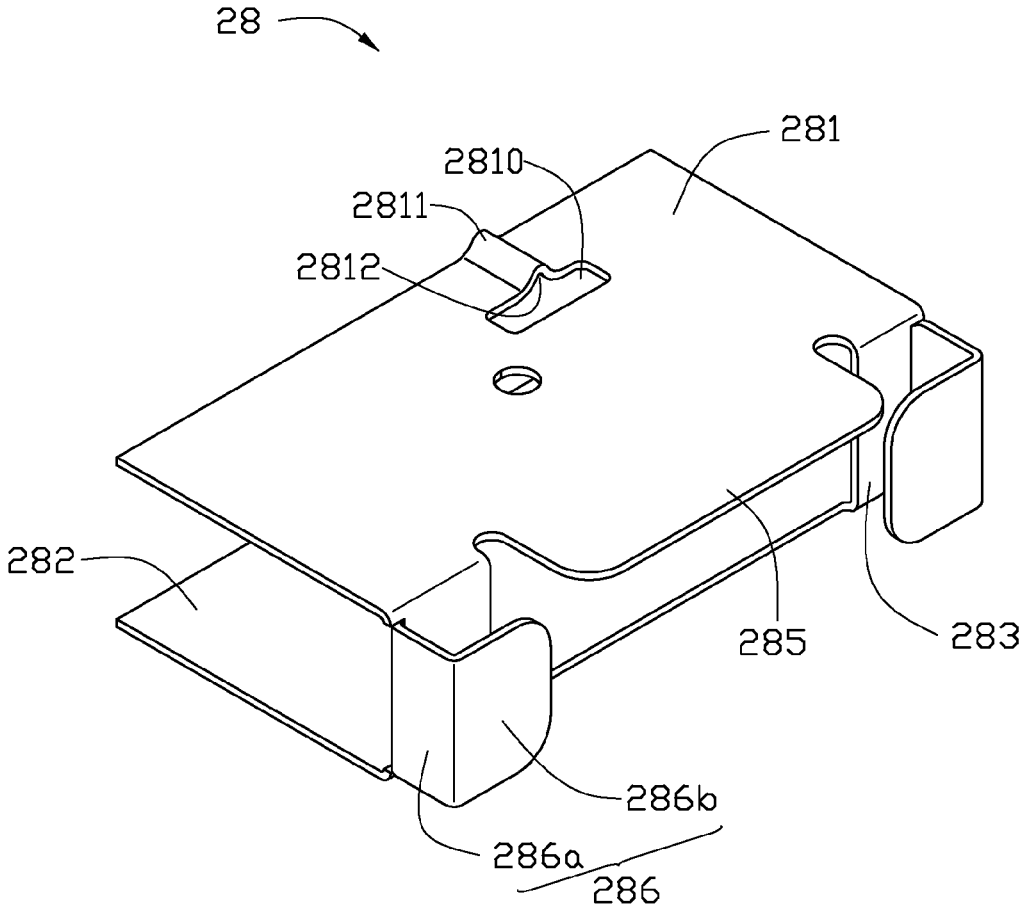
FIG. 7 is a schematic, enlarged view of a second fastener of FIG. 3.

Referring to FIG. 7, each of the second fasteners 28 generally has a U shape. The second fasteners 28 can be made of metals such as steel and copper. In order to increase the elasticity of metals, the metals can be heat treated. The second fasteners 28 can also be made of resin or plastic with good elasticity.

The second fastener 28 comprises a third holding piece 281, a fourth holding piece 282, and a second connecting piece 283. The third holding piece 281 and the fourth holding piece 282 can be substantially parallel to each other. The second connecting piece 283 extends between the third holding piece 281 and the fourth holding piece 282. The second connecting piece 283 can be substantially perpendicular to the third holding piece 281 and the fourth holding piece 282.

The distance between the third holding piece 281 and the fourth holding piece 282 can be equal to or slightly smaller than the thickness of the base 21. Accordingly, the third holding piece 281 and the fourth holding piece 282 can tightly clamp opposite sides of the base 21 if the base 21 is inserted between the third holding piece 281 and the fourth holding piece 282. As a result, the second fastener 28 can be installed on the base 21 via engagement of the base 21 and the third and fourth holding pieces 281 and 282.

The second fastener 28 further comprises two second extending portions 286. The second extending portions 286 are formed on opposite ends of the second connecting piece 283. Each of the second extending portions 286 comprises a first portion 286*a* and a second portion 286*b*. The first portion 286*a* extends substantially perpendicularly from an outer edge of the second connecting piece 283. The first portion 286*a* is substantially perpendicular to the third and fourth holding pieces 281 and 282. The second portion 286*b* extends substantially perpendicularly from a distal end of the first portion 286*a*. The second portion 286*b* is substantially parallel to the second connecting piece 283. The second portions 286*b* extend towards each other.

The second fastener 28 further comprises a guiding portion 285 which is located between the two second extending portions 286. The guiding portion 285 extends from a joint portion between the third holding piece 281 and the second connecting piece 283 in a direction away from the third holding piece 283. The guiding portion 285 has a height equal to the height of the first portion 286*a* measured from the second connecting piece 283.

Furthermore, a second rib 2811 protrudes from the third holding piece 281 in a direction away from the fourth holding piece 282. Accordingly, a second wiring channel 2812 is formed under the second rib 2811 and opposite to the fourth holding piece 282. The second wiring channel 2812 can be substantially straight and extend in a direction substantially perpendicular to the third holding piece 283. The second wiring channel 2812 is arranged to aim at or correspond to one of the two second extending portions 286. One second cutout 2810 is defined in the third holding piece 281 and communicates with second wiring channel 2812.

In one embodiment, the thermoacoustic device 20 can be assembled together according to the following steps.

First, the first fasteners 26 and the second fasteners 28 are installed on the base 21. In this step, the first fasteners 26 are installed on the first end 212 of the base 21 at predesigned interval in a manner described above. The second fasteners 28 are installed on the second end 214 of the base 21 at predesigned interval in a manner described above. The first fasteners 26 are aligned with the second fasteners 28 in a one-to-one manner. The first holding pieces 261 and the third holding pieces 281 are disposed on the surface 210 of the base 21.

Second, the first electrodes 23 and the second electrodes 24 are mounted on the base 21 via the first fasteners 26 and the second fasteners 28. In this step, the first electrodes 23 and the second electrodes 24 are installed in the first fasteners 26 and the second fasteners 28 in the same manner. One of the first electrodes 23 will be taken as an example to illustrate how to install the first and second electrodes 23 and 24 in the first and second fasteners 26 and 28.

The first electrode 23 has a first end and an opposite second end. The second end of the first electrode 23 is extended through the second wiring channel 2812 and the second cutout 2810, and then is fixed on one of the second extending portions 286 which aligns with the second wiring channel 2812. In this process, the second end of the first electrode 23 is guided and supported by the guiding portion 285. The second end of the first electrode 23 can be fixed on one of the second extending portions 286 via welding or other methods.

The first end of the first electrode 23 is extended through the first wiring channel 2612, the first cutout 2610, and then is fixed on the flexible element 266 via welding or other methods. After the first and second ends of the first electrode 23 are fixed by the first fastener 26 and the second fastener 28, the first electrode 23 can apply a force on the flexible element 266 in the direction from the first fastener 26 to the second fastener 28 or along an axial direction of the first electrode 23. The flexible element 266 will generate an elastic deformation in the direction from the first fastener 26 to the second fastener 28. Accordingly, the first electrode 23 can be stretched between the first fastener 26 and the second fastener 28, in one embodiment, the first electrode 23 is flexible.

Finally, the sound wave generator 25 is disposed on the first electrodes 23 and the second electrodes 24; therefore, the thermoacoustic device 20 is assembled. In one embodiment, the sound wave generator 25 can be secured on the first electrodes 23 and the second electrodes 24 via conductive paste or conductive adhesive. Components of the conductive paste or conductive adhesive can include metal particles, binders and solvents. The metal particles can include gold particles, silver particles, and aluminum particles. In one embodiment, some sound wave generators 25 can be adhered directly to the first electrode 23 and the second electrode 24, because some of the carbon nanotube structures have large specific surface area. This will result in a good electrical contact between the sound wave generator 25 and the first and second electrodes 23 and 24.

In one embodiment, the loudspeaker 1 can be assembled together according to the following steps.

First, the assembled thermoacoustic device 20 is positioned in the first frame 110*a* with the base 21 supported by the flanges 112. Second, a first conductive element such as a wire (not shown), is electrically connected to extending portions 286, which are electrically connected to the first electrodes 23. A second conductive element such as a wire (not shown), is electrically connected to extending portions 286, which are electrically connected to the second electrodes 24. The first conductive element and the second conductive element can extend out of the framework 10 through the grooves 1142. Finally, the second frame 110*b* is put on and engages with the first frame 110*a*, so that the thermoacoustic device 20 can be installed therebetween. Therefore, the loudspeaker 1 is assembled together.

In operation of the loudspeaker 1, the sound wave generator 25 receives signal output from the first electrodes 23 and the second electrodes 24 and produces sound waves. In this process, the sound wave generator 25 generates lots of heat. The first electrodes 23 and the second electrodes 24 will be heated and expand due to thermal expansion. The expansion of the first electrodes 23 and the second electrodes 24 will cause an elastic deformation or movement of the flexible element 266 in the direction from the first fastener 26 toward the second fastener 28. Therefore, the expansion of the first electrodes 23 and the second electrodes 24 can be absorbed by allowing them to travel between the first fasteners 26 and the second fasteners 28. Accordingly, the expansion of the first electrodes 23 and the second electrodes 24 would not cause deformations of the first electrodes 23 and the second electrodes 24 in a direction perpendicular to an axis direction of them. Thus, a deformation of the sound wave generator caused by the expansion of the electrodes in the conventional loudspeakers can be eliminated or significantly reduced.

It is noteworthy that, in one embodiment, the second fasteners can be omitted and the first ends of the first electrodes can be directly fixed on the base. The first conductive element can be electrically connected to first extending portion 269 which electrically connect to the first electrodes 23. The second conductive element can be electrically connected to the first extending portion 269, which electrically connects to the second electrodes 24. It is noteworthy that, in one embodiment, the first fasteners can replace the second fasteners.

Figure 8:
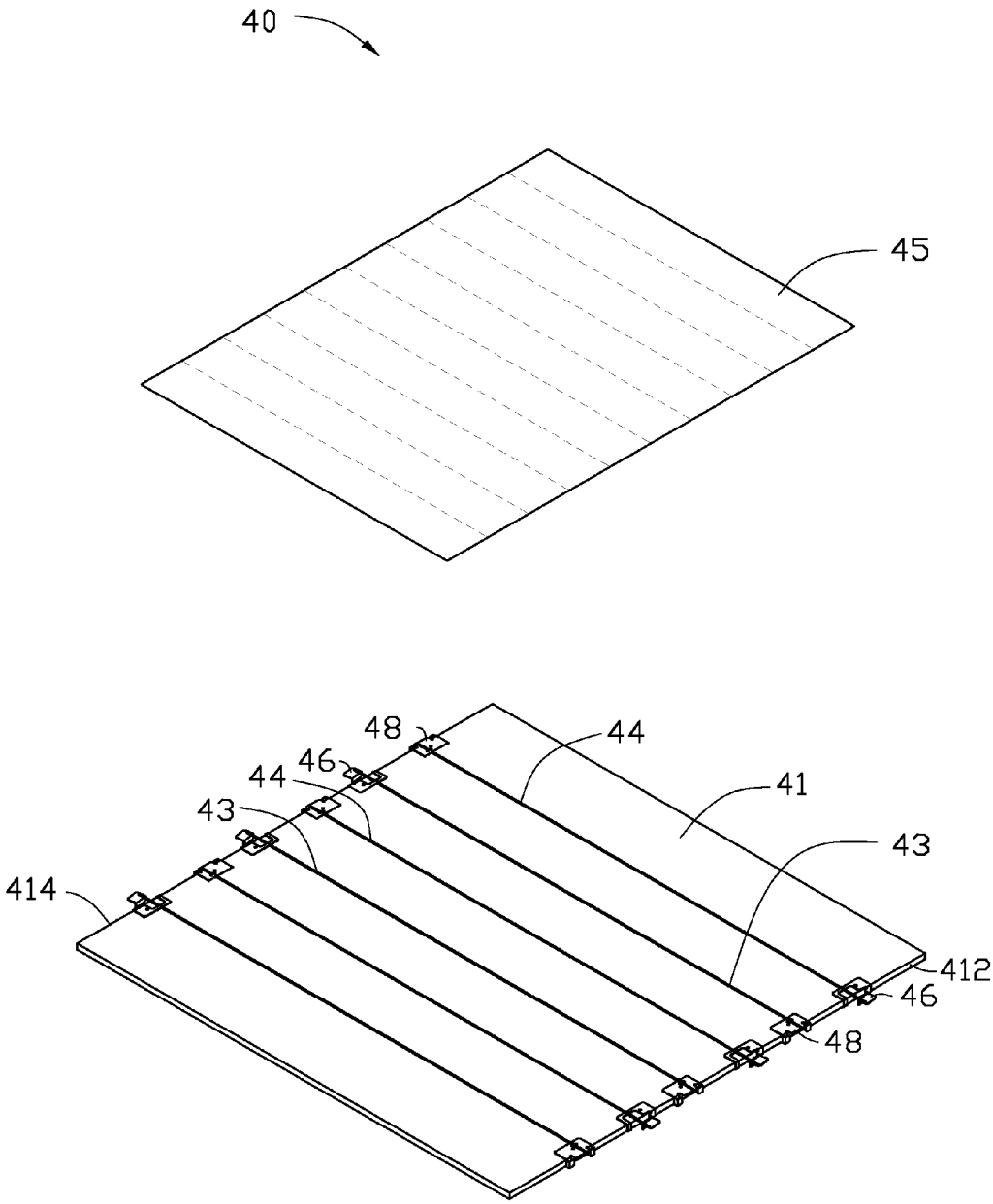
FIG. 8 is an exploded schematic structural view of a thermoacoustic device of another embodiment.

FIG. 8 is an exploded schematic structural view of a thermoacoustic device of another embodiment. The thermoacoustic device 40 is similar to the thermoacoustic device 20, and also comprises a base 41, a plurality of first electrodes 43, a plurality of second electrodes 44, a sound wave generator 45, a plurality of first fasteners 46 and a plurality of second fasteners 48. The main difference between the thermoacoustic device 40 and the thermoacoustic device 20 is that the first fasteners 46 and the second fasteners 48 are alternatively installed on each of the first end 412 and the second end 414 of the base 41 at predesigned interval.

Figure 9:
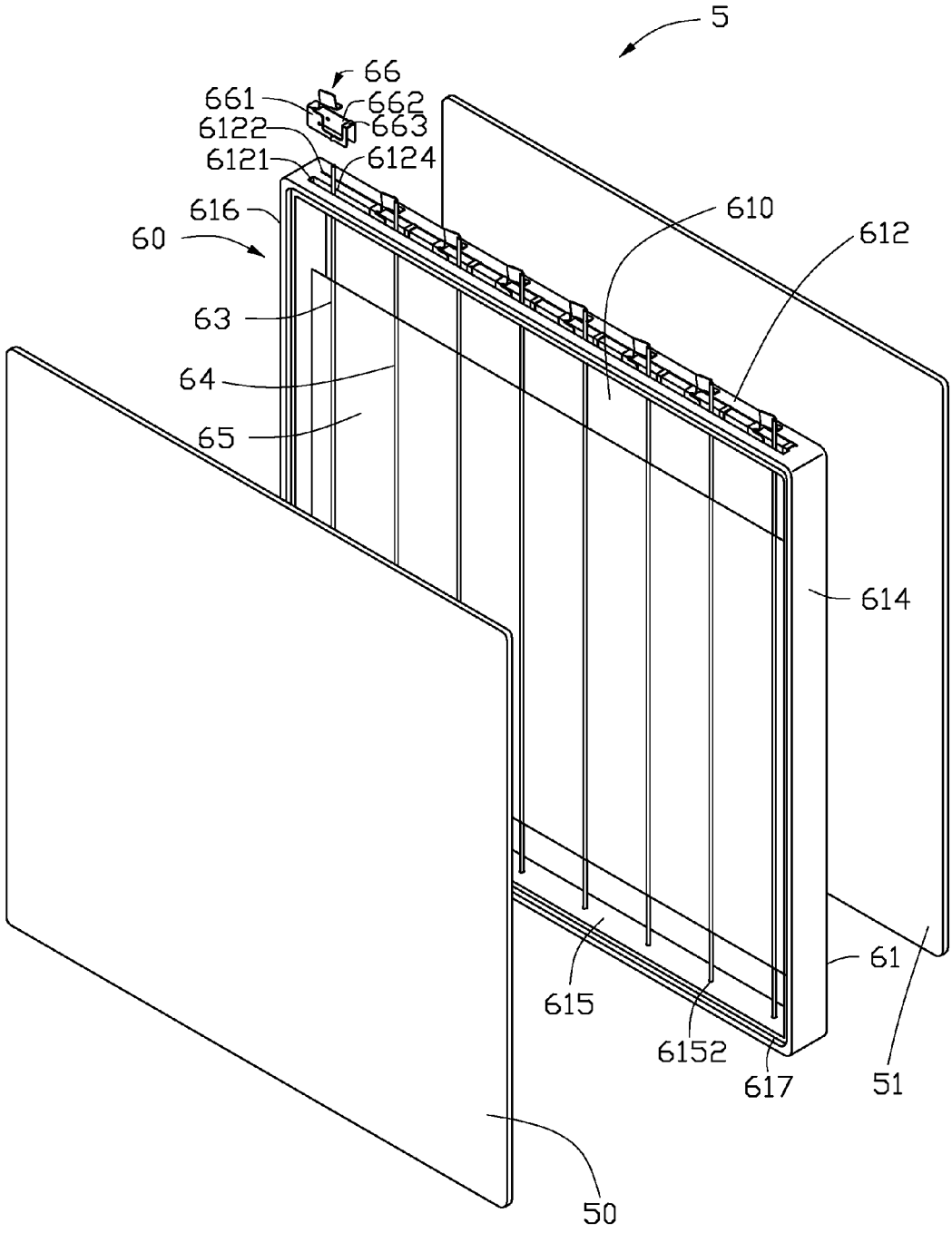
FIG. 9 is a schematic structural view of another embodiment of a loudspeaker.

Referring to FIG. 9, one embodiment of a loudspeaker 5 is provided. The loudspeaker 5 comprises a thermoacoustic device 60 and two covers 50 and 51 secured on opposite sides of the thermoacoustic device 60. The covers 50 and 51 can be transparent glass substrate.

The thermoacoustic device 60 comprises a base 61, a plurality of first electrodes 63, a plurality of second electrodes 64, a sound wave generator 65, and a plurality of first fasteners 66. The first electrodes 63 and the second electrodes 64 are secured on the base 61 via the first fasteners 66. The sound wave generator 65 is electrically supported by the first electrodes 63 and the second electrodes 64. Alternatively, the thermoacoustic device 60 can comprise a single first electrode 63 and a single second electrode 64 spaced from the first electrode 63, and the sound wave generator 65 can be electrically supported by the first electrode 63 and the second electrode 64.

The first electrodes 63 and the second electrodes 64 can be the same as the electrodes described above and be alternatively arranged on the base 61.

The sound wave generator 65 is a sound producing member of the loudspeaker 5. The sound wave generator 65 can be the same as the sound wave generator 25 described above. The sound wave generator 65 can be arranged on the first electrodes 63 and the second electrodes 64 in the same or similar manner described above.

The first fasteners 66 can be the same as the first fasteners 26 described above. Each of the first fasteners 66 also comprises a first holding piece 661, a second holding piece 662, and a first connecting piece 663 extending between the first holding piece 661 and the second holding piece 662. The first fasteners 66 are secured on the base 61 and are used to install the first electrodes 63 and the second electrodes 64 on the base 61.

The base 61 is a substantially rectangular frame formed by first, second, third and fourth members 612, 614, 615 and 616 joined end to end. The base 61 can be made of insulating materials, such as glass, ceramics, resin, wood, quartz, plastic. In one embodiment, the base 61 is integrally formed and made of resin. The first member 612 and the third member 615 are substantially parallel to each other. The second member 614 and the fourth member 616 are substantially parallel to each other. An approximately square window 610 is defined by the first, second, third and fourth members 612, 614, 615, and 616.

On each sides of the thermoacoustic device 60, a flange 617 inwardly extends from an inner edge of each of first, second, third and fourth members 612, 614, 615, and 616, and a step is formed between the flanges 617 and a corresponding one of the first, second, third and fourth members 612, 614, 615, and 616. The four flanges 617 on each of the opposite sides of the thermoacoustic device 60 together contacts and support one of the covers 50 and 51.

A first slot 6121 and a second slot 6122 are defined and spaced in or through the first member 612 with a beam 6124 left between the first slot 6121 and the second slot 6122. The first slot 6121, the second slot 6122 and the beam 6124 extend along a lengthwise direction of the first member 612. The first slot 6121 and the second slot 6122 are substantially parallel to each other.

The first slot 6121 is used to receive the first holding pieces 661, the first electrodes 63, and the second electrodes 64. The first slot 6121 has a width in a direction from the first slot 6121 to the second slot 6122. The width of the first slot 6121 is equal to or larger than a sum of the thickness of the first holding piece 661 and the diameter of the first electrode 63 (the second electrode 64).

The second slot 6122 is used to receive the second holding pieces 662. The second slot 6122 has a width in the direction from the first slot 6121 to the second slot 6122. The width of the second slot 6122 is equal to or larger than the thickness of the second holding piece 662.

The beam 6124 has a width in the direction from the first slot 6121 to the second slot 6122. The width of the beam 6124 is equal to or larger than a distance between the first holding piece 661 and the second holding piece 662. Accordingly, the first fasteners 66 can be secured on the base 61 via clamping on the beam 6124.

A plurality of through holes 6152 are spaced through the third member 615. The through holes 6152 are arranged in a line, which is parallel to and aligns with the first slot 6121, so that opposite ends of each of the first, second electrodes 63 and 64, can be installed in the through holes 6152 and the first slot 6121, respectively. The through holes 6152 have a diameter so that they can receive ends of the first electrodes 63 and the second electrodes 64.

In one embodiment, the thermoacoustic device 60 can be assembled together according to the following steps.

First, the first fasteners 66 are installed in the base 61. In this step, the first fasteners 66 are installed in the first member 612 at predesigned interval. The first holding pieces 661 are received in the first slot 6121. The second holding pieces 662 are received in the second slot 6122. Accordingly, the beam 6124 can be clamped by the first fasteners 66.

Second, the first electrodes 63 and the second electrodes 64 are mounted on the base 61 in the same manner. One of the first electrodes 63 will be taken as an example to illustrate how to install the first and second electrodes 63 and 64.

The first electrode 63 has a first end and an opposite second end. The second end of the first electrode 63 is extended into and is fixed in one of the through holes 6152. The second end of the first electrode 63 can be fixed in one of the through holes 6152 via welding or other methods. The first end of the first electrode 63 is extended into the first slot 661 and then is fixed on one of the first fasteners 66 in the same or similar manner described above.

Finally, the sound wave generator 65 can be disposed on the first electrodes 63 and the second electrodes 64 in the same or similar manner described above; therefore, the thermoacoustic device 60 is assembled.

In one embodiment, the loudspeaker 5 can be assembled together according to the following steps.

First, each of the covers 50 and 51 are disposed in the opposite sides of the assembled thermoacoustic device 60. In this step, the each of the covers 50, 51 is positioned on the flanges 617 at corresponding sides of the assembled thermoacoustic device 60.

Second, the first electrodes 63 are electrically connected together and the second electrodes 64 are electrically connected together. In this step, a first conductive element such as a wire (not shown), can be electrically connected to portions of the first electrodes 63 extending out of the thermoacoustic device 60 through the through holes 6152. A second conductive element such as a wire (not shown), is electrically connected to portions of the second electrodes 64 extending out of the thermoacoustic device 60 through the through holes 6152. Therefore, the loudspeaker 5 is assembled together.

It is noteworthy that, in one embodiment, the cover 50 can contact or be spaced from the sound wave generator 65, and the cover 51 can contact or spaced from the first, second electrodes 63 and 64.

It is also noteworthy that, in one embodiment, the through holes 6152 can be replaced with the second fasters described above, and the second fasters can be secured on the third member 615 in the same or similar manner as that employing for installing the first fasteners 66 in the first member 612.

Figure 10:
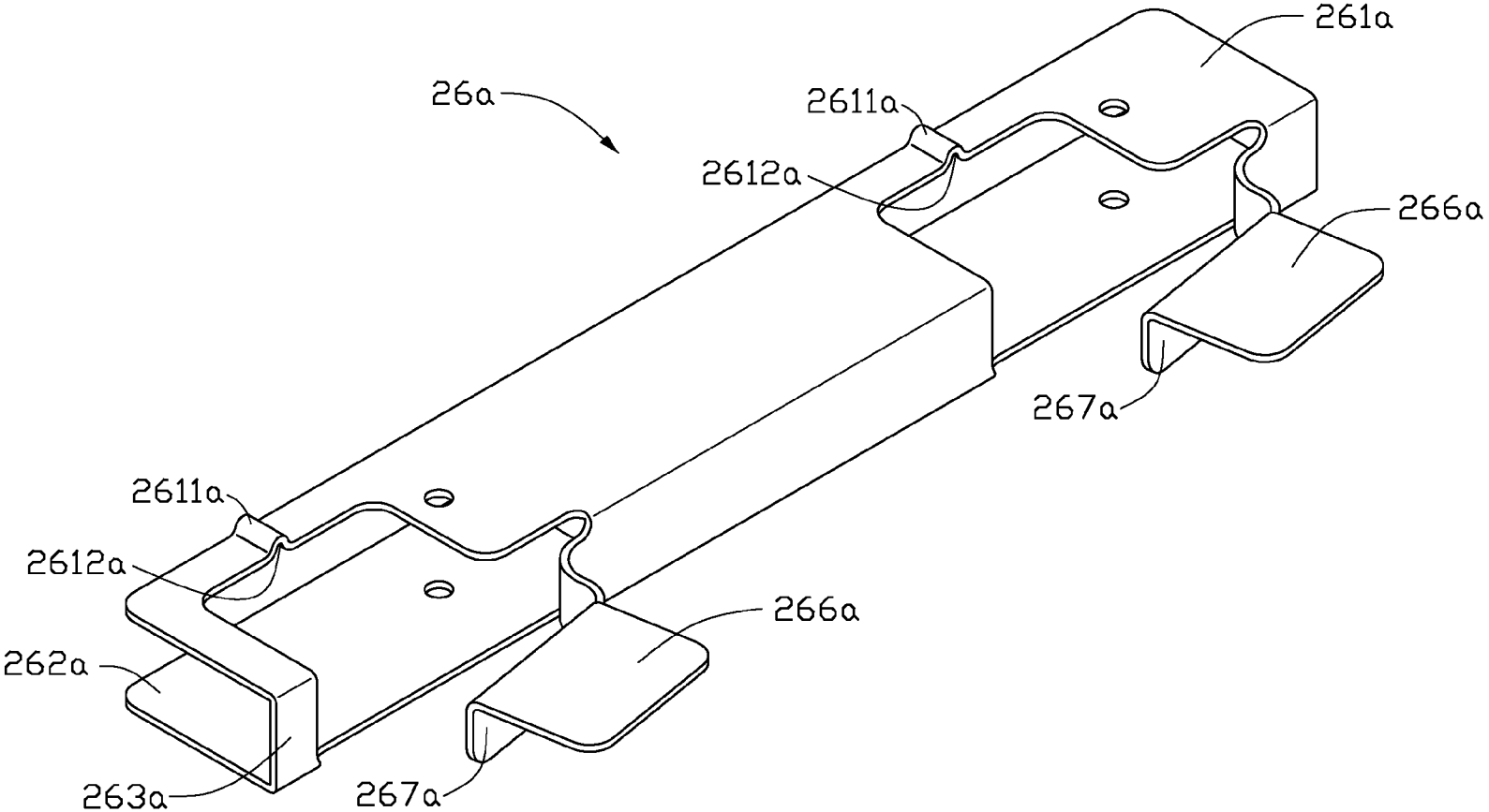
FIG. 10 is a schematic, enlarged view of a first fastener of a thermoacoustic device of another embodiment.

It is also noteworthy that, in one embodiment, two or more first fasteners can be integrally formed. As shown in FIG. 10, the first fastener 26*a* comprises a first holding piece 261*a*, a second holding piece 262*a*, a first connecting piece 263*a*, a plurality of flexible elements 266*a*, and a plurality of first ribs 2611*a*.

The first holding piece 261*a* and the second holding piece 262*a* can be substantially parallel to each other. The first connecting piece 263*a* extends between the first holding piece 261 a and the second holding piece 262*a*. The flexible elements 266*a* are formed on the first connecting piece 263*a* at regular interval. Each of the flexible elements 266*a* is same to the flexible element 266 described above. The first ribs 2611 a protrude from the first holding piece 261 a in a direction away from the second holding piece 262*a*. Accordingly, a first wiring channel 2612*a* is formed under each of the first ribs 2611 a and opposite to the second holding piece 262*a*. The first wiring channels 2612*a* can be substantially straight and extend in a direction substantially perpendicular to the installing portions 267*a*. The first wiring channels 2612*a* can aim directly at the installing portions 267*a* of the first fasteners 26*a* in a one-to-one manner. The first fastener 26*a* can be secured on the first member 612 in the same or similar manner to/as that employing for installing the first fasteners 66 on the first member 612.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A thermoacoustic device comprising:

a base;

a plurality of first fasteners each comprising a body engaging with the base and a flexible element extending from the body;

at least one first electrode having a first end and a second end, wherein the first end engages with the flexible element of one of the plurality of first fasteners, and the second end is secured to the base;

at least one second electrode having a third end and a fourth end, wherein the third end engages with the flexible element of one of the plurality of first fasteners, and the fourth end is secured to the base, wherein the first end and the third end are not engaged to the same flexible element; and a sound wave generator electrically connected to the at least one first electrode and the at least one second electrode.

2. The thermoacoustic device of claim 1, wherein the flexible element comprises a neck portion and an installing portion, the neck portion extends from the body in a direction away from the base, and the installing portion extends from a neck portion distal end.

3. The thermoacoustic device of claim 2, wherein the installing portion and the neck portion together form a cantilever beam.

4. The thermoacoustic device of claim 2, wherein the body comprises a first holding piece, a second holding piece, and a first connecting piece extending between the first holding piece and the second holding piece, the body engages with the base via the first holding piece and the second holding piece; and the neck portion extends from the first connecting piece.

5. The thermoacoustic device of claim 4, wherein the flexible element further comprises a first extending portion, and the first extending portion is substantially parallel to the first holding piece and substantially perpendicularly formed on the installing portion.

6. The thermoacoustic device of claim 4, wherein each of the plurality of first fasteners further comprises a first rib protruding from the first holding piece in a direction away from the second holding piece and a first wiring channel under the first rib, and the first wiring channel aims directly at the installing portion, wherein the first end extends through the first wiring channel and is secured on the flexible element.

7. The thermoacoustic device of claim 6, wherein the first wiring channel is substantially straight and extends in a direction substantially perpendicular to the installing portion.

8. The thermoacoustic device of claim 4, further comprising a plurality of second fasteners disposed on the base, each of the plurality of second fasteners comprising a third holding piece, a fourth holding piece, a second connecting piece, and a second extending portion; wherein the second connecting piece extends between the third holding piece and the fourth holding piece, and the second extending portion extends from the second connecting piece in a direction away from the third holding piece; wherein each of the plurality of second fastener engages with the base via the third holding piece and the fourth holding piece, and the second end of the at least one first electrode and the fourth end of the at least one second electrode engage with second extending portions of the plurality of second fasteners in a one-to-one manner.

9. The thermoacoustic device of claim 8, wherein the second extending portion comprises a first portion and a second portion, and the first portion extends substantially perpendicularly from the second connecting piece and is substantially perpendicularly to the third and fourth holding pieces, and the second portion extends substantially perpendicularly from a first portion distal end and is substantially parallel to the second connecting piece.

10. The thermoacoustic device of claim 9, wherein each of the plurality of second fastener further comprises a guiding portion extending from a joint portion between the third holding piece and the second connecting piece in a direction away from the third holding piece, and the guiding portion has a height equal to a height of the first portion measured from the second connecting piece.

11. The thermoacoustic device of claim 9, wherein the second fastener further comprises a second rib protruding from the third holding piece in a direction away from the fourth holding piece, and a second wiring channel under the second rib and opposite to the fourth holding piece; and the second end of the at least one first electrode and the fourth end of the second electrode are extended through second wiring channels of the plurality of second fasteners and secured on the second extending portions of the plurality of second fasteners in a one-to-one manner.

12. The thermoacoustic device of claim 4, wherein the base is a substantially flat substrate having a surface, the first holding piece is located on the surface of the flat substrate, and the at least one first electrode and the at least one second electrode are disposed on the surface of the flat substrate.

13. The thermoacoustic device of claim 4, wherein the base is a frame comprising a plurality of member joined end to end, the base comprises a first slot and a second slot defined in one of the members, the first holding piece and the at least one first electrode are received in the first slot, and the second holding piece are received in the second slot.

14. The thermoacoustic device of claim 13, wherein a beam is defined between the first slot and the second slot and has a width in a direction from the first slot to the second slot, and the width of the beam is equal to or larger than a distance between the first holding piece and the second holding piece.

15. The thermoacoustic device of claim 1, further comprising a plurality of second fasteners disposed on the base, each of the plurality of second fasteners comprising a third holding piece, a fourth holding piece, a second connecting piece, and a second extending portion; wherein the second connecting piece extends between the third holding piece and the fourth holding piece, and the second extending portion extends from the second connecting piece in a direction away from the third holding piece; wherein each of the plurality of second fastener engages with the base via the third holding piece and the fourth holding piece, and the second end of the at least one first electrode and the fourth end of the at least one second electrode engage with second extending portions of the plurality of second fasteners in a one-to-one manner.

16. A loudspeaker comprising:

a base;

a plurality of first fasteners, each of the plurality of first fasteners comprising a body engaging with the base and a flexible element extending from the body;

at least one linear first electrode having a first end and a second end, wherein the first end engages with the flexible element of one of the plurality of first fasteners, and the second end is secured on the base;

at least one linear second electrode substantially parallel to the at least one linear first electrode, the at least one linear second electrode having a third end and a fourth end, wherein the third end engages with the flexible element of one of the plurality of first fasteners, and the fourth end is secured on the base; and a sound wave generator comprising a carbon nanotube structure electrically connected to the at least one linear first electrode and the at least one linear second electrode;

wherein the flexible element has elasticity in a direction from the first end to the second end of the at least one linear first electrode, and the first end and the third end are not engaged to the same flexible element.

17. The loudspeaker of claim 16, wherein the body comprises a first holding piece, a second holding piece, and a first connecting piece extending between the first holding piece and the second holding piece; the body engages with the base via the first holding piece and the second holding piece; and the flexible element comprises a neck portion and an installing portion, the neck portion extends from the body in a direction away from the base, and the installing portion extends diagonally or substantially perpendicularly from a neck portion distal end.

18. The loudspeaker of claim 17, wherein the installing portion and the neck portion together form a cantilever beam.

19. A loudspeaker comprising:

a base;

a fastener comprising a body engaging with the base and a plurality of spaced flexible elements extending from the body;

at least one first electrode having a first end and a second end, wherein the first end engages with one of the plurality of flexible elements, and the second end is secured on the base;

at least one second electrode having a third end and a fourth end, wherein the third end engages with one of the plurality of flexible elements, and the fourth end is secured on the base; and a sound wave generator comprising a carbon nanotube structure electrically connected to the at least one first electrode and the at least one second electrode.

20. The loudspeaker of claim 19, wherein the body comprises a first holding piece, a second holding piece, and a first connecting piece extending between the first holding piece and the second holding piece, the body engages with the base via the first holding piece and the second holding piece; and each of the plurality of flexible elements comprises a neck portion and an installing portion, the neck portion extend from the body in a direction away from the base, the installing portion diagonally or substantially perpendicularly extends from a the neck portion distal end.

* * * * *

UNITED STATES PATENT AND TRADEMARK OFFICE

CERTIFICATE OF CORRECTION

PATENT NO. : 8,284,965 B2
APPLICATION NO. : 12/848221
DATED : October 9, 2012
INVENTOR(S) : Liang Liu et al.

It is certified that error appears in the above-identified patent and that said Letters Patent is hereby corrected as shown below:

Title Page, below Item (22) insert

-- (30) Foreign Application Priority Data

Dec. 28, 2009 (CN) .....200910260283.2 --

Signed and Sealed this
Twenty-second Day of October, 2013

Teresa Stanek Rea
*Deputy Director of the United States Patent and Trademark Office*